United States Patent [19]

Salviati

[11] 4,300,881

[45] Nov. 17, 1981

[54] TRUCK OR THE LIKE FOR CONVEYING CERAMIC ARTICLES THROUGH A KILN

[75] Inventor: Antonio Salviati, Vicenza, Italy

[73] Assignee: Salviata Impianti S.p.A., Vicenza, Italy

[21] Appl. No.: 117,509

[22] Filed: Feb. 1, 1980

[51] Int. Cl.[3] ..... F27B 9/26

[52] U.S. Cl. ..... 432/241; 432/243; 296/1 R; 105/422

[58] Field of Search ..... 432/241, 239, 243; 296/1 R; 105/422, 413, 355

[56] References Cited

U.S. PATENT DOCUMENTS

| | | | |
|---|---|---|---|
| 1,521,216 | 12/1924 | Dressler | 432/241 |
| 1,636,073 | 7/1927 | Robertson | 432/241 |
| 2,013,043 | 9/1935 | Fox | 105/422 |
| 2,117,397 | 5/1938 | Bonsall | 105/422 |
| 3,003,810 | 10/1961 | Kloote et al. | 105/422 |
| 3,377,670 | 4/1968 | Davis | 432/241 |
| 3,416,465 | 12/1968 | Turpen | 105/422 |
| 3,759,661 | 9/1973 | Barsby | 432/241 |
| 3,997,289 | 12/1976 | Bowers | 432/241 |
| 4,243,385 | 1/1981 | Jeffries, Jr. | 432/241 |

*Primary Examiner*—Henry C. Yuen

*Attorney, Agent, or Firm*—Birch, Stewart, Kolasch & Birch

[57] ABSTRACT

The present invention relates to a truck for conveying ceramic articles through a tunnel kiln, comprising a baseplate or trolley, a frame of refractory material formed on the base and bearing a surface for loading ceramic articles. The frame is made up of box-shaped section members having a C cross-section open toward the interior of the frame. The loading surface is formed by a number of ceramic rollers rotatably held in corresponding bearing means resting on the side of the frame parallel to the direction of the motion of the truck through the tunnel kiln (FIG. 2).

15 Claims, 3 Drawing Figures

TRUCK OR THE LIKE FOR CONVEYING CERAMIC ARTICLES THROUGH A KILN

BACKGROUND TO THE INVENTION

The present invention related to a truck or the like for conveying ceramic articles, more particularly bricks and tiles, through a kiln, e.g. a tunnel kiln.

It is known that when ceramic articles are conveyed through a kiln, a truck of the aforementioned kind, in order to obtain optimum thermodynamic and fluid-dynamic results, must: form the hearth of the furnace; efficiently seal off the heat flow; efficiently seal off undesired flows of gas (interfering air) entering or leaving the kiln, and greatly reduce any losses of heat (sensible heat) at the kiln outlet.

With regard to its structure, the truck must: bear the load of ceramic articles for which it is designed; be easy to manipulate during loading or unloading of the ceramic articles to be fired and when they are conveyed through the kiln, and permit a flow of hot fumes below the load so as to obtain desired contact between the fumes and the ceramic articles.

Trucks used heretofore for conveying ceramic articles through a tunnel kiln are made of refractory rammed lining and insulating refractories disposed on a metal base frame. Since the trucks are made with particular allowance for their ability to bear a load, they generally have considerable bulk, particularly height, and weight between 1.5 times and twice the weight of the load. This results in well-known, recognized difficulties of manufacturing and manipulating the trucks. Because of their bulk, considerable heat losses occur at the outlet and during their stay outside of the kiln. In addition, continuous damage may be produced by the considerable internal stresses resulting from repeated, intense thermal shocks to which the trucks are exposed when travelling through the furnace, and the considerable temperature differences between their top and bottom walls. As a result, frequent maintenance is required and the average life of the trucks is limited to two or three years. In addition, due to their great bulk, the trucks have such high thermal inertia that they influence the thermodynamic conditions to which the load of ceramic articles is exposed during firing. In order to prevent interfering air entering the kiln, conventional trucks have cross-sectional peripheral edges which are given uniform profiles and are generally made of refractory blocks, which are joined together by an uneconomic, difficult method.

Maintenance of these trucks is expensive because it requires skilled staff and the truck masonry frequently has to be totally taken apart and remade.

SUMMARY OF THE INVENTION

The present invention is based on the problem of constructing a truck for conveying ceramic articles, more particularly bricks and tiles, through a kiln, so as to meet the aforementioned requirements and overcome the disadvantages of the prior art.

To this end, the present invention provides a truck comprising a metal baseplate and characterised in that it comprises:

a frame formed on the plate and comprising a number of box-shaped sectional members of refractory material disposed end to end and having a substantially C-shaped cross-section with horizontal arms extending towards the interior of the frame, a filling of thermally insulating fibrous material disposed in the box-like sectional members;

a number of containers made of refractory material positioned on the baseplate inside the frame, the containers having substantially the same height as the frame, and a filling of thermally insulating fibrous material in and between the containers.

Advantageously, a truck according to the present invention also comprises a layer of flexible, thermally insulating material of predetermined thickness disposed on the frame and on the containers and completely covering them.

According to another feature, the truck according to the present invention comprises:

at least two bearing means disposed above the layer of flexible material and bearing on opposite sides of the frame and extending in the direction of motion of the truck through the kiln; and a number of tubular ceramic rollers transversely held in freely rotatable manner by the bearing means, the ceramic rollers defining a bearing plane for the load of ceramic articles.

BRIEF DESCRIPTION OF THE DRAWINGS

Other features and advantages of a truck for conveying ceramic articles according to the present invention will be clear from the following description, with particular reference to the accompanying drawings in which.

DESCRIPTION OF A PREFERRED EMBODIMENT

Figure 1:
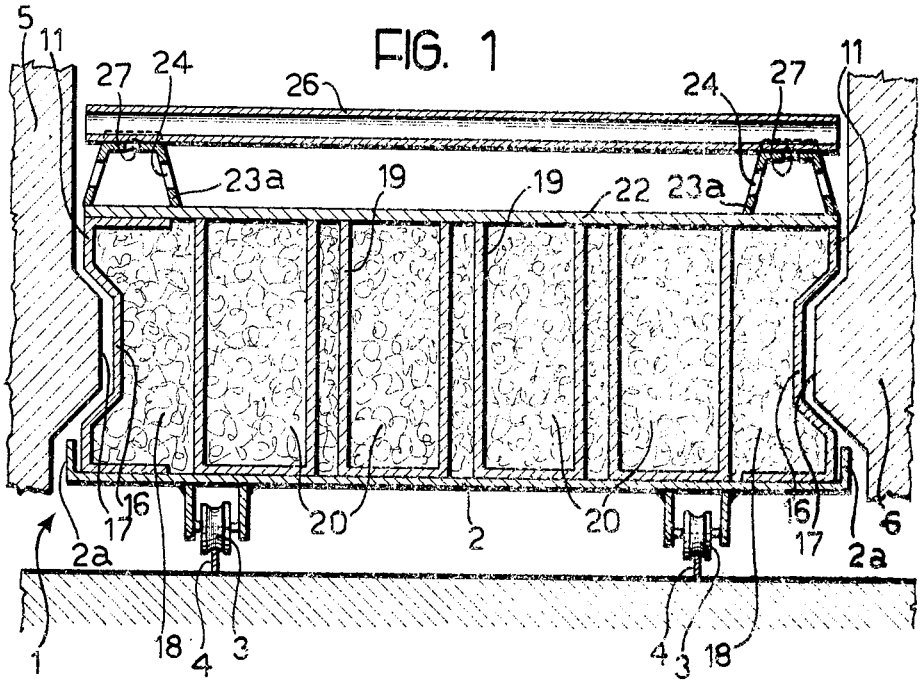
FIGS. 1 and 2 are large-scale views of a truck according to the present invention, in cross-section and longitudinal section, respectively.
Figure 2:
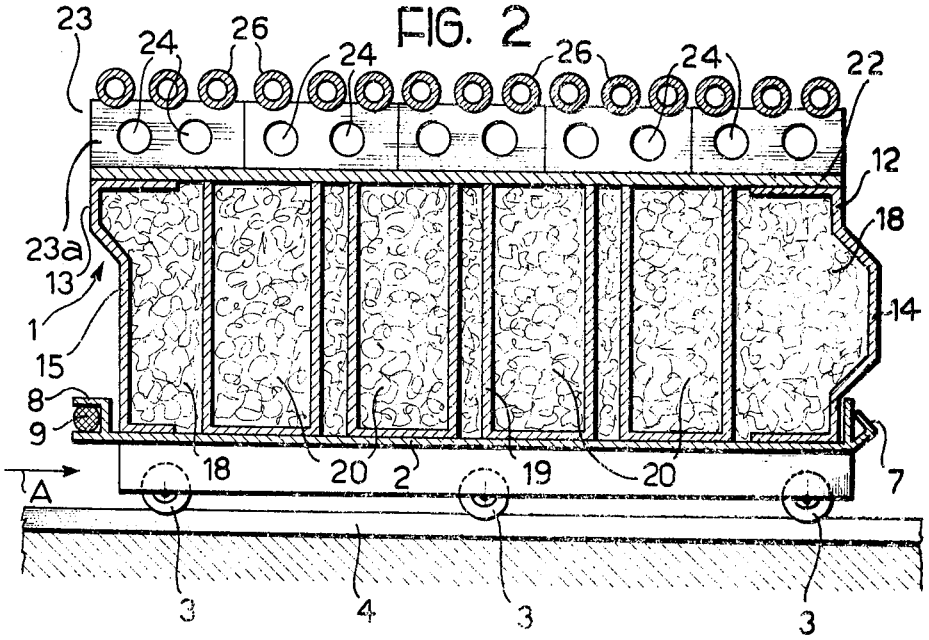
Figure 3:
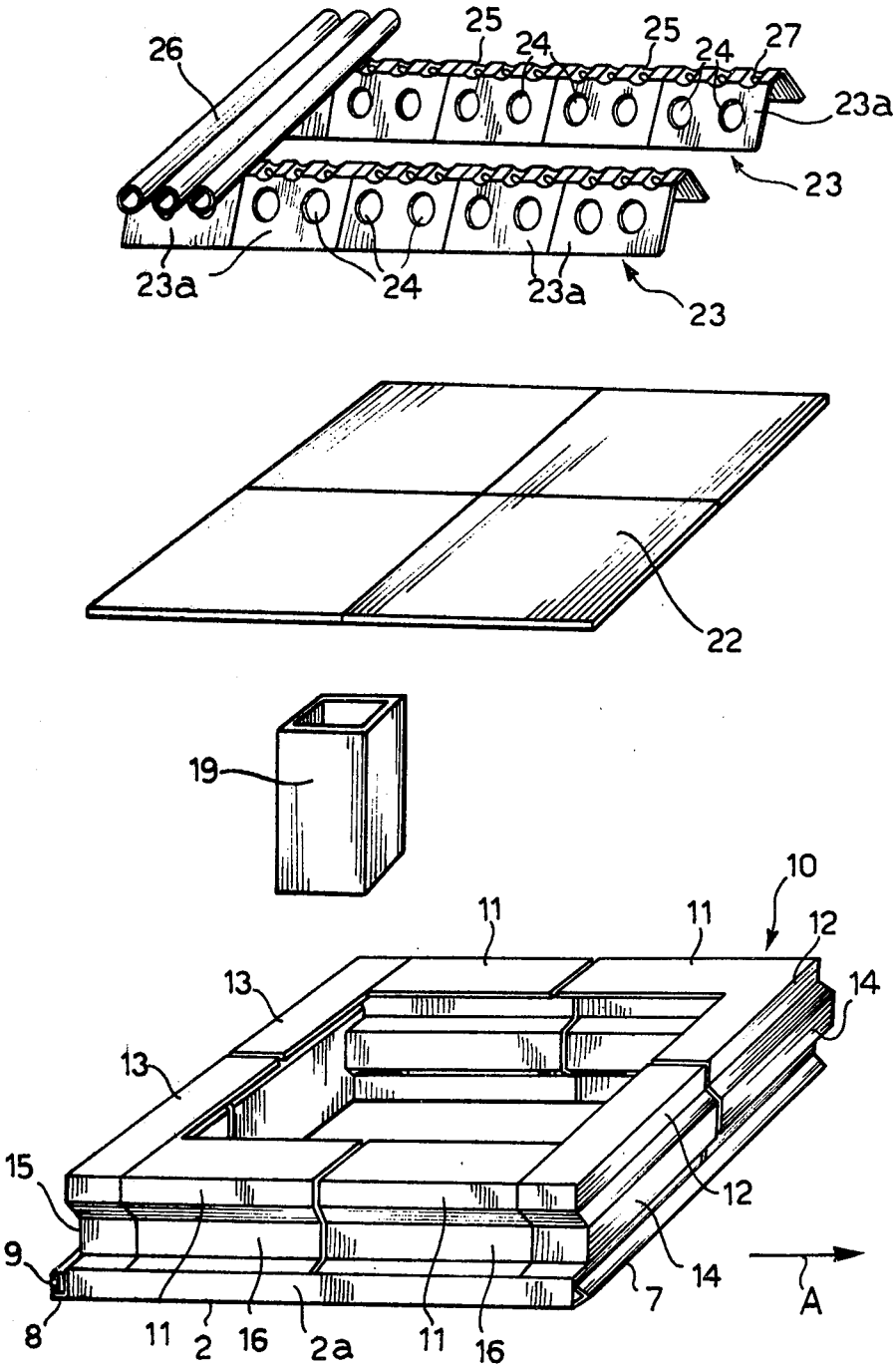
FIG. 3 is a perspective view of the separate parts of a truck according to the present invention.

In the drawings, reference 1 denotes a truck for conveying ceramic articles through a tunnel kiln having side walls 5 and 6 (diagrammatically indicated in FIG. 1). The truck has a metal baseplate 2 having predetermined dimensions, equipped in conventional manner with pairs of wheels 3 engaging rails 4 extending longitudinally through the kiln. Baseplate 2 is tray-shaped owing to the presence of a peripheral edge 2*a* bent upwards. The front end (with reference to the direction A of motion of the truck through the tunnel kiln) of the baseplate is formed with a projection 7 having a triangular cross-section with its apex towards the front, whereas the rear end is secured to a substantially C-section member 8 open towards the back. Section member 8 holds a body 9 made of resiliently deformable material. The front projection 7 of a truck 1 is designed to engage the section member 8 of a preceding truck in the tunnel kiln.

Baseplate 2 bears a peripheral frame 10 made up of a number of box-shaped section members 11, 12, 13 made of suitable refractory material, disposed end to end and all having a substantially C-shaped cross-section with horizontal arms extending towards the interior of frame 10. More particularly section members 11, which form the sides of frame 10 parallel to the direction of motion A, are all equal and have cross-sectional walls so as to form re-entrant parts 16,16. The re-entrant parts have a profile matching that of beads 17,17 formed in walls 5,6 of the tunnel kiln and co-operating therewith to define labyrinths to limit heat losses through downward radiation. The section members 12 forming the front end of frame 10 have walls shaped to form a projection or male part 14 whereas the section members 13 forming the rear end of frame 10 have walls shaped to form a re-entrant or female part 15 having a shape matching that of part 14.

All the section members 11, 12, and 13 are joined end to end by fitting into one another without adhesive. To this end, each section member has a profiled male end and the other end has a matching female profile.

Section members 11, 12 and 13, which are preferably made of cordierite, are filled with a thermally insulating fibrous material 18. A number of containers 19 made of material resistant to thermal shocks (cordierite) are disposed on baseplate 2 and inside frame 10 and regularly spaced. Fibrous thermally insulating material 20 is disposed in and between containers 19, the height of which is equal to that of frame 10. A layer of flexible, thermally insulating material 22 of given thickness is disposed on frame 10 and on the group of containers 19. Two bearing means 23, 23 rest on the sides of frame 10 parallel to the direction of motion A of the truck and above layer 22. Each bearing means 23 is made up of a number of hollow members **23*a* disposed in line and having a cross-section which is substantially an isosceles trapezoid without a major base. The inclined walls of hollow members 23*a* are formed with through apertures 24 for reducing weight and for ventilation, whereas the top walls of members 23*a* are formed with semicircular cradles 25 adapted to receive and hold a number of tubular ceramic rollers 26. Other ventilation apertures 27 are formed opposite cradles 25**.

When a number of trucks 1 travel through a tunnel kiln, the lateral re-entrant parts 16,16 of the frames 10 engage the beads 17,17 on the inner walls 5, 6 of the kiln and form a labyrinth which is very efficient against heat losses through downward radiation. Since trucks 1 travel through the tunnel kiln by being pushed forward, the front projection 7 of each engages the rear sectional member 8 of the preceding truck whereas the projecting or male part formed at the front of each frame 10 engages the re-entrant or female part 15 formed at the back of the frame on the preceding truck. Consequently, the trucks form a very efficient, reduced-thickness insulating heart for the tunnel kiln.

The following are other advantages of a truck according to the invention:

The bulk and weight are less than those of conventional trucks having equal ability to bear loads;

There is a reduction in heat losses on leaving the kiln;

There is a bearing surface made up of freely rotatable rollers, thus ensuring linear contact between the surface and the material loaded on it, resulting in a reduced "thermal shadow". The ceramic rollers, which can freely rotate in the associated seats or cradles, allow the articles carried by them to move in response to thermal fluctuations.

The heat flow is appreciably reduced because the truck is almost completely filled with insulating material which is a very poor conductor.

There is a reduction in the size of the truck and a consequent reduction in the thermal gradient between its top and bottom portions.

There is nothing to prevent thermal expansion of the frame components, since the box-shaped section members of the frame are joined without adhesive.

Maintenance is easy, and a single damaged component can be replaced independently of the others, since it is easy to remove, and The truck can be used unchanged in devices for drying green ceramic articles.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A truck for conveying ceramic articles through a kiln comprising a base plate, truck frame members disposed on said base plate, said truck frame members defining the walls of said truck;

at least two load bearing means disposed on said frame members on opposite sides thereof, and a plurality of tubular roller means held by said bearing means, transversely with respect thereto, and in a freely rotatable manner and in spaced relationship from said frame members, said roller means serving as the bearing surface for supporting the ceramic articles to be treated.

2. The truck of claim 1 wherein said frame members comprise a plurality of box-shaped sectional members of refractory material disposed in an end-to-end relationship.

3. The truck of claim 1 wherein the box-shaped sectional members contain a thermally insulating fibrous material.

4. The truck of claim 3 wherein a plurality of containers made of a refractory material are disposed on said base plate within said frame members, said containers having substantially the same height as the frame members.

5. The truck of claim 4 wherein a thermally insulating fibrous material is disposed within and between said containers.

6. The truck of claim 1 wherein a layer of flexible, thermally insulating material of predetermined thickness is disposed between the bearing means and the frame membranes.

7. The truck of claim 1 wherein the bearing means are provided with a plurality of grooves for holding said roller means.

8. The truck of claim 7 wherein said bearing means contain a plurality of apertures for weight reduction and ventilation.

9. The truck of claim 1 wherein the bearing means are disposed on opposite sides of the frame members and extend in the direction of movement of the truck through the kiln and the tubular ceramic rollers are held transversely to said direction of movement.

10. The truck of claim 1 wherein the truck frame members have a substantially C-shaped cross-section with horizontally disposed arms extending toward the interior of the truck frame.

11. The truck of claim 1 containing wheel means.

12. The truck of claim 1 wherein the base plate has a tray-shaped configuration with upwardly extending peripheral edges.

13. The truck of claim 1 wherein the front end thereof is provided with a front projection, and the rear end thereof is provided with a C-section member opening towards the rear, said C-section containing a resilient deformable material, whereby the front projection is adapted to engage the C-section of a preceding truck.

14. The truck of claim 1 wherein the front end and rear end portions of the truck have matching male and female profiles for nesting with adjacent trucks having similar matching profiles.

15. The truck of claim 2 wherein each box-shaped sectional members has matching profiled male and female end portions.

* * * * *